US009381661B2

(12) United States Patent
Ingole et al.

(10) Patent No.: US 9,381,661 B2
(45) Date of Patent: Jul. 5, 2016

(54) CORROSION PROTECTED ANVIL AND KNIFE CUTTING ASSEMBLY

(71) Applicant: Curt G. Joa, Inc., Sheboygan Falls, WI (US)

(72) Inventors: Sudeep Ingole, Sheboygan, WI (US); Lloyd Kreif, Fredonia, WI (US)

(73) Assignee: Curt G. Joa, Inc., Sheboygan Falls, WI (US)

( * ) Notice: Subject to any disclaimer, the term of this patent is extended or adjusted under 35 U.S.C. 154(b) by 124 days.

(21) Appl. No.: 14/507,486

(22) Filed: Oct. 6, 2014

(65) Prior Publication Data

US 2015/0096177 A1 Apr. 9, 2015

Related U.S. Application Data

(60) Provisional application No. 61/887,649, filed on Oct. 7, 2013.

(51) Int. Cl.
*B26D 7/08* (2006.01)
*B26D 1/40* (2006.01)

(52) U.S. Cl.
CPC . *B26D 7/08* (2013.01); *B26D 1/405* (2013.01)

(58) Field of Classification Search
CPC ..... B26D 7/08; B26D 1/405
USPC ..... 83/22, 73, 98, 100, 168, 169, 284, 308, 83/343, 673, 675
See application file for complete search history.

(56) References Cited

U.S. PATENT DOCUMENTS 855,389 A * 5/1907 Dawkins ..... H01L 41/45 172/438
3,623,965 A 11/1971 Owren
3,736,243 A * 5/1973 Duggan ..... C23F 13/005 204/196.26
3,803,012 A * 4/1974 Kurr ..... C23F 13/02 204/196.16
4,143,479 A * 3/1979 Kingston ..... A01K 97/02 414/412
4,621,669 A * 11/1986 Kivimaa ..... B23P 25/003 144/209.1
4,661,213 A * 4/1987 Dorsett ..... C25D 17/14 205/117
4,772,361 A * 9/1988 Dorsett ..... C25D 7/0614 204/206
5,711,079 A * 1/1998 Fischer ..... B26B 5/00 30/342
5,898,044 A * 4/1999 Nooren ..... C09K 3/10 404/25
6,069,197 A * 5/2000 Daech ..... C09J 11/04 156/327
6,731,965 B2 * 5/2004 Menon ..... A61B 5/04087 600/391
6,839,968 B2 * 1/2005 Brown, Jr. ..... B26B 21/222 30/50
2011/0278267 A1 * 11/2011 Kawakami ..... B23K 26/0846 219/121.67
2015/0096177 A1 * 4/2015 Ingole ..... B26D 7/08 30/123

FOREIGN PATENT DOCUMENTS

CA 2547438 11/2006
DE 102007062936 A1 7/2009
WO 2009/141114 * 11/2009 ..... B26D 7/18

* cited by examiner

*Primary Examiner* — Sean Michalski
(74) *Attorney, Agent, or Firm* — Ryan Kromholz & Manion, S.C.

(57) ABSTRACT

A corrosion protected knife and anvil system is disclosed. A source of lubricating fluid is provided to a lubricating fluid distribution mechanism, coupled to both a knife blade and a salt bridge and an associated sacrificial anode. The sacrificial anode is consumed in order to protect corrosion on a rotating knife blade, which intermittently contacts both an associated anvil in order to cut material used in making disposable products, and the source of lubricating fluid. A knife holder holds a knife which is corrosion protected by an impressed current anode.

8 Claims, 3 Drawing Sheets

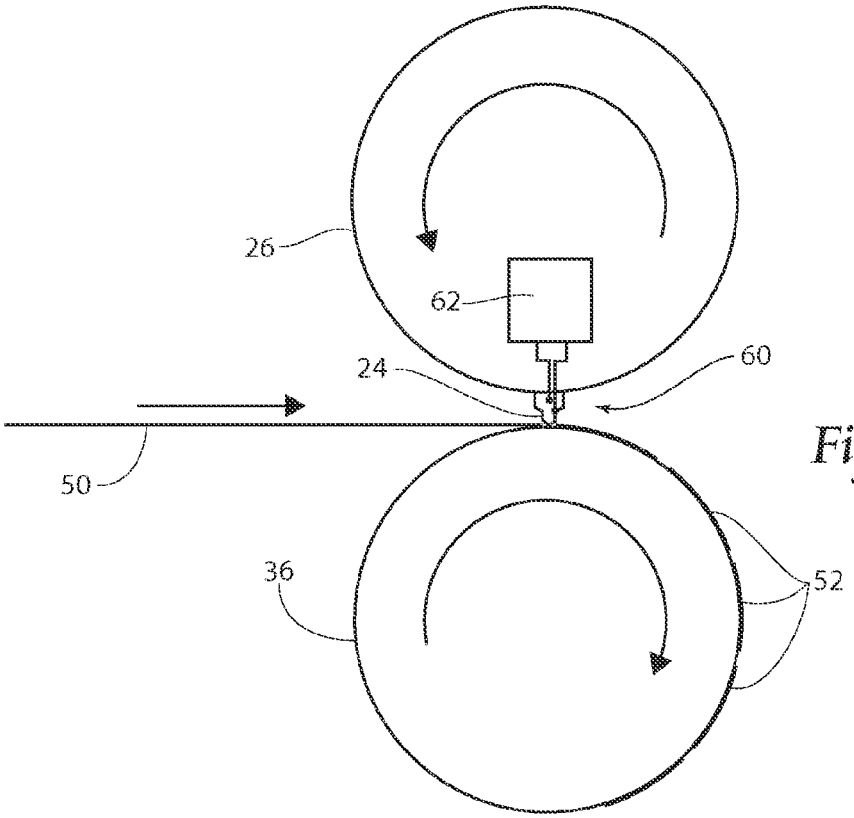
Fig. 3
Fig. 4
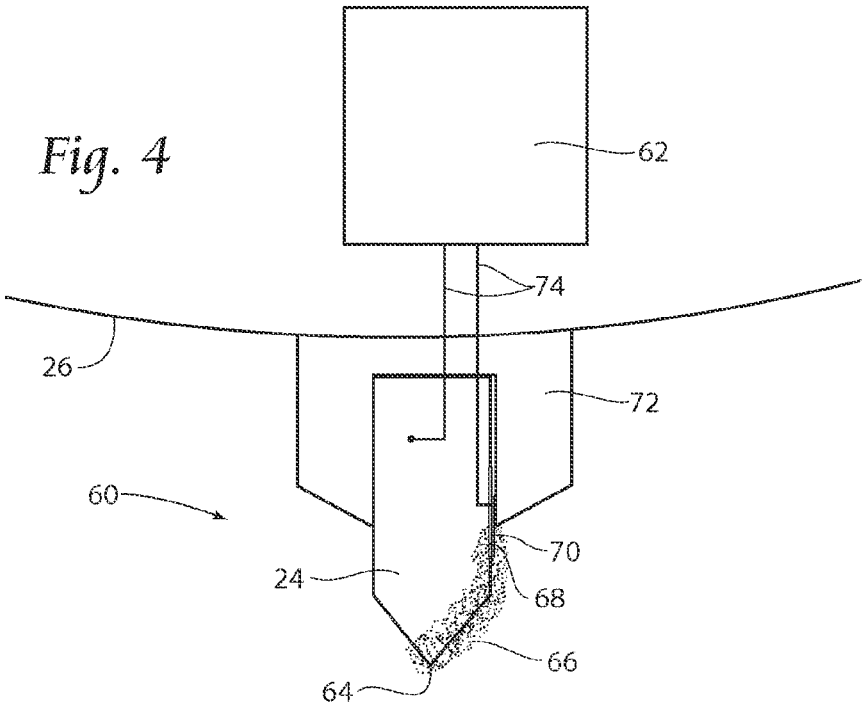

CORROSION PROTECTED ANVIL AND KNIFE CUTTING ASSEMBLY

RELATED APPLICATION

This application claims the benefit of co-pending U.S. Provisional Patent Application Ser. No. 61/887,649, filed 7 Oct. 2013.

BACKGROUND OF THE INVENTION

The present invention relates to disposable hygiene products and more specifically, to methods and apparatuses for processing disposable hygiene products. More specifically, the invention relates to cutting and applying segments of one web to attach to a disposable diaper. Various types of automatic manufacturing equipment have been developed which produce the desired results with a variety of materials and configurations.

When manufacturing hygiene products, such as baby diapers, adult diapers, disposable undergarments, incontinence devices, sanitary napkins and the like, a common method of applying discrete pieces of one web to another is by use of a slip-and-cut applicator. A slip-and-cut applicator is typically comprised of a cylindrical rotating vacuum anvil, a rotating knife roll, and a transfer device. In typical applications, an incoming web is fed at a relatively low speed along the vacuum face of the rotating anvil, which is moving at a relatively higher surface speed and upon which the incoming web is allowed to "slip". A knife-edge, mounted on the rotating knife roll, cuts a off a segment of the incoming web against the anvil face. This knife-edge is preferably moving at a surface velocity similar to that of the anvil's surface. Once cut, the web segment is held by vacuum drawn through holes on the anvil's face as it is carried at the anvil's speed downstream to the transfer point where the web segment is transferred to the traveling web.

Typical vacuum rolls used in the prior art have rows of vacuum holes which are fed by cross-drilled ports, each being exposed to the source of vacuum by commutations, as the ports move into a zone of negative pressure in a stationary manifold. Such a configuration serves to apply vacuum sequentially to each successive row of holes.

Current knife or die designs can wear over time. It has been discovered that one source of dulling is corrosion. It would be desirable to avoid dulling through corrosion.

SUMMARY OF THE INVENTION

A corrosion protected knife and anvil system is disclosed. A source of lubricating fluid is provided to a lubricating fluid distribution mechanism, coupled to both a knife blade and a salt bridge and an associated sacrificial anode. The sacrificial anode is consumed in order to protect corrosion on a rotating knife blade, which intermittently contacts both an associated anvil in order to cut material used in making disposable products, and the source of lubricating fluid.

BRIEF DESCRIPTION OF THE DRAWINGS

FIG. 3 is a side view of an alternate embodiment of a corrosion protected anvil/knife combination of the present invention;

FIG. 4 is a side closeup view of an alternate embodiment of a corrosion protected anvil/knife combination of the present invention.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
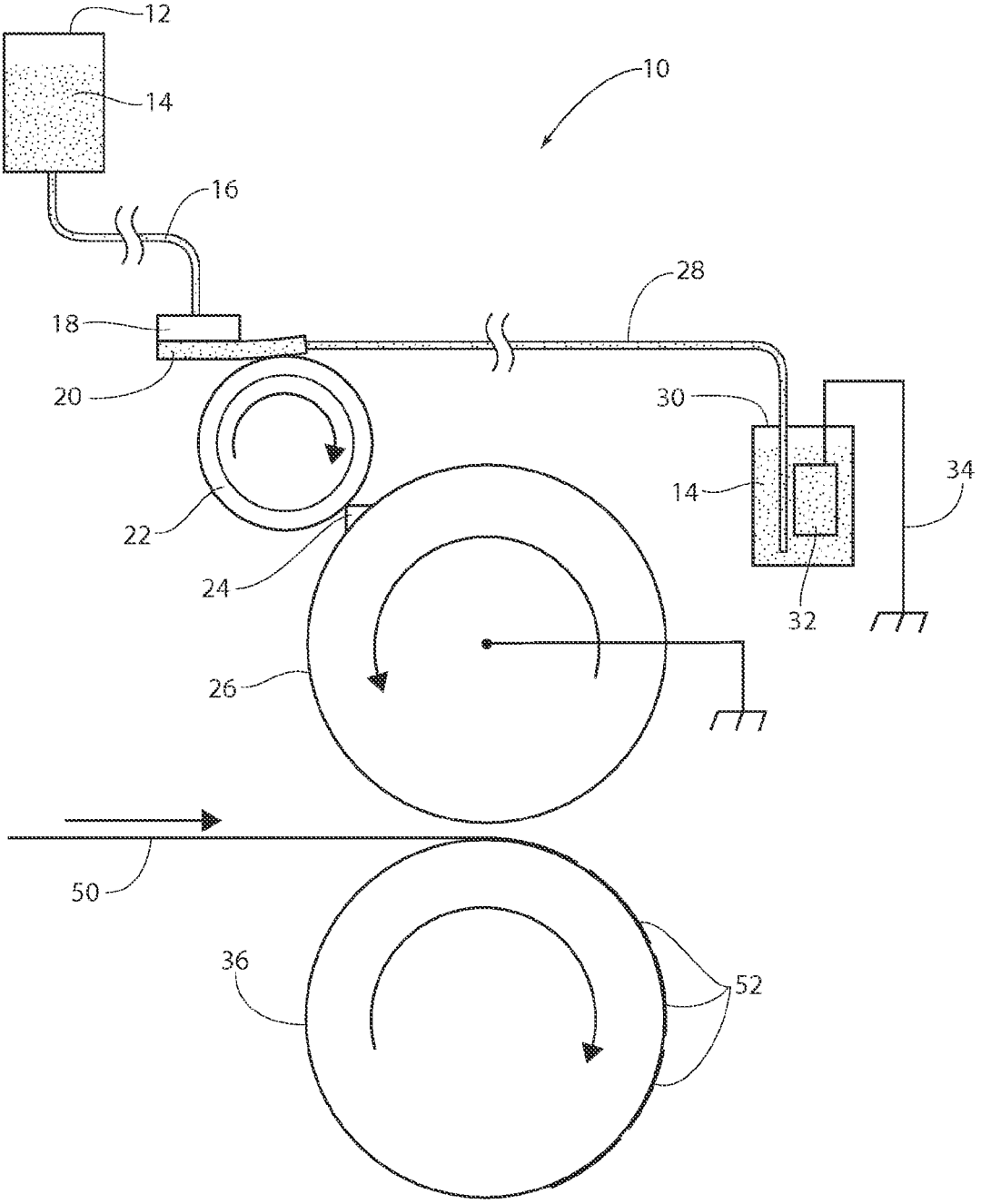
FIG. 1 is a side view of a corrosion protected anvil/knife combination of the present invention, the knife receiving an electrolyte.

Referring now to FIG. 1, a perspective view of a corrosion protected anvil/knife combination of the present invention is shown. A fluid reservoir 12 containing fluid 14 provides fluid 14 through fluid distribution line 16 to fluid manifold 18. Fluid 14 is distributed preferably evenly through manifold 18 to fluid distribution layer 20. Fluid distribution layer 20 can be felt-like, as felt has appropriate fluid distribution and application properties. Fluid distribution layer 20 applies fluid 14 to rotating roller 22, which can be foam-like. Rotating roller 22 rotates in a paint-roller like fashion after beinq contacted by knife blade 24 during rotation of knife blade 24 carried by drum 26. Knife blade 24 is used to sever an incoming web 50 between the knife 24 and anvil 26, and severed pieces 52 being carried by the rotating vacuum anvil 36, as is well known in the art.

A salt bridge or fluid bridge 28 facilitates flow of electrons between fluid distribution layer 20, rotating roller 22, and ultimately knife blade 24—and fluid 14 containing oxidation vessel 30 which holds a sacrificial anode 32. Sacrificial anode 32 is electrically connected to knife blade 24 by wire 34 to a common potential as anvil 26. Sacrificial anodes are formed with active metals such as aluminum and zinc, and the sacrificial anode and 32, and intermittently catholically protected blade 24 are used to prevent corrosion on knife blade 24, as the knife blade 24 is formed of a less active material surface than sacrificial anode 32. Sacrificial anode 32 is slowly consumed in place of active corrosion taking place on knife blade 24.

Salt bridge 28, formed of any appropriate conductive fluid or solid, allows the flow of ions to maintain a balance in charge between the knife blade 24 and fluid 14 contained in oxidation vessel 30. A sacrificial anode 32 is preferably formed with a material exhibiting a tendency to lose ions that is greater than that of the knife blade 24. Zinc and aluminum are suitable. With the charge difference balanced, the reduction and oxidation reactions can proceed.

Sacrificial anode 32 slowly oxidizes as the sacrificial anode 32 loses ions to knife blade 24 through this circuit. It is noted that the circuit is created intermittently as knife blade 24 rotates, and knife blade 24 is only in contact with the rotating roller 22 once per revolution of drum 26. This intermittent electrical coupling between blade 24 and the sacrificial anode 32 turns the blade 24 into an intermittent cathode.

Referring now to FIGS. 3 and 4, an alternate embodiment of a corrosion protected anvil and knife cutting assembly 60 is shown. Knife edge 64 is at a distal portion of knife 24.

It is desirable to protect knife edge 64 from corrosion. Corrosion can eat away at knife edge 64 as electrons of the knife 24 migrate away from edge portion 64. Over time, knife edge 64 can degrade and dull if not properly protected.

Figure 2:
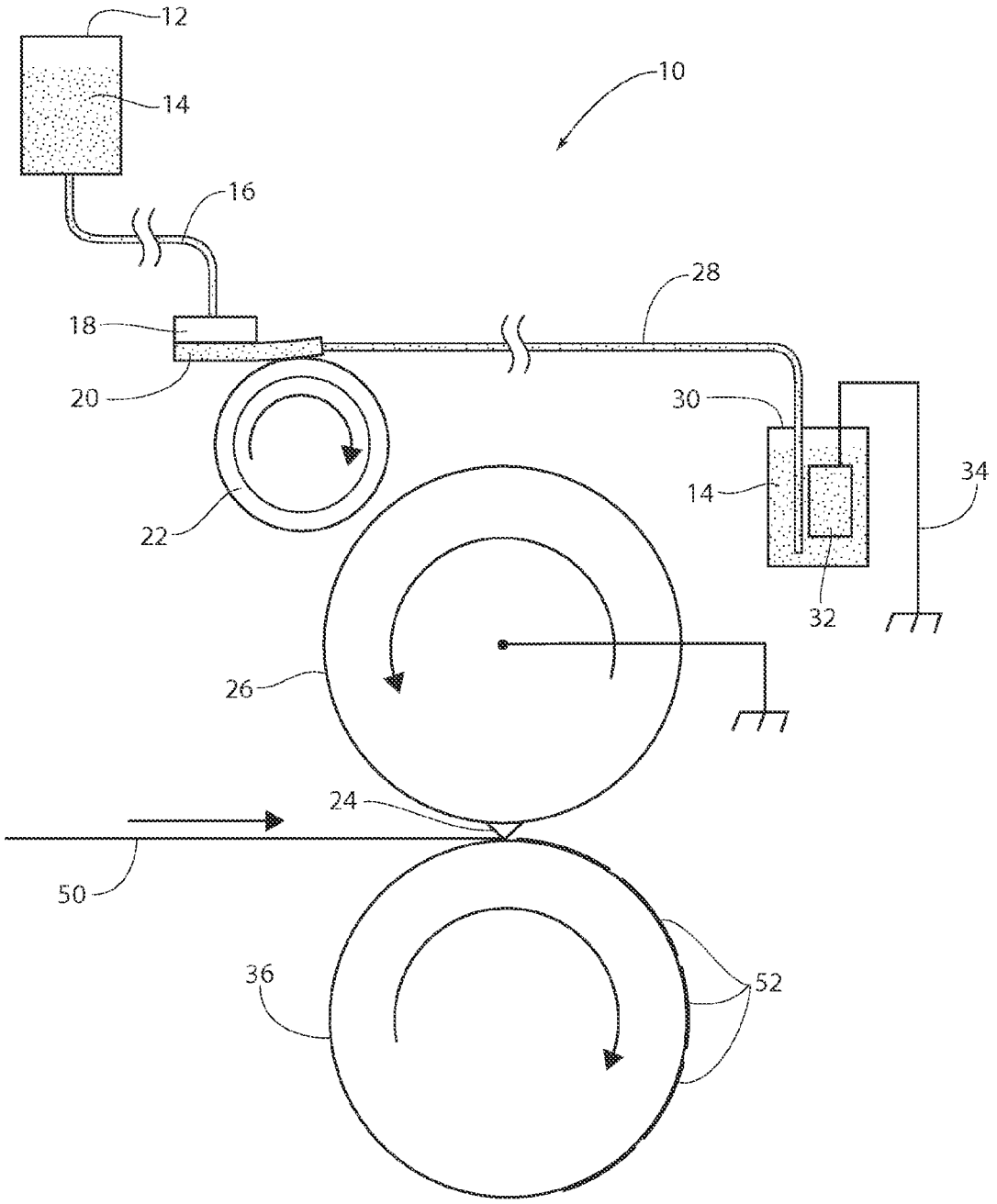
FIG. 2 is a side view of the corrosion protected anvil/knife combination of the present invention, the knife severing an incoming web.

Electrolyte 66, which can be wax water, is provided to knife edge 64 for instance as previously described with reference to FIGS. 1 and 2. Insulator coating 68 is provided about a body of the knife 24. Insulator coating 68 can be provided about each or all sides of knife body 24. Insulator coating 68 separates the knife body 24 and knife edge 64 (which is to he protected) from an impressed current anode 70. Impressed current anode 70 can take the form of another coating provided on top of insulator coating 68. The cathode and anode 70 are preferably connected to each other through the electrolyte 66.

Preferably, impressed current anode 70 is located close to the knife edge 64, to provide connection with electrolyte 66. Electrolyte 66 is preferably applied to knife edge 64 and impressed current anode 70 to provide for flow of electrons to occur and therefore the cathodic protection.

There is a potential provided between the knife body 24, and the impressed current anode 70. A connection between the impressed current anode 70 and knife body 24 is created through battery wires or connectors 74, and a battery 62 carried by rotating drum or knife roll 26. Knife holder 72 is carried by the rotating drum or knife roll 26, and carries knife 24. Knife holder 72 may be modified in order to accommodate the impressed current anode 70 design. This will provide easy access for connection to the impressed current anode 70. Through knife holder 72, one of the battery connections 74 is provided to couple impressed current anode 70 with battery 62. The other battery connection 74 couples battery 62 with knife 24. Battery 62 is mounted on or carried by rotating drum 26. Battery 62 can comprise any potential energy source such as a magnet or an EMF source. The knife edge 64 is thereby protected from corrosion and degradation.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A corrosion protected knife assembly comprising:
a knife blade carried by a knife;
an electrolyte carried by said knife blade;
a potential energy source coupled with said knife and coupled with an anode coupled to said knife.

2. A corrosion protected knife assembly according to claim 1, said knife coupled to a knife holder carried by a rotating drum.

3. A corrosion protected knife assembly according to claim 2, said knife intermittently contacting a source of electrolyte.

4. A corrosion protected knife assembly according to claim 1, said knife further comprising an insulating layer between said knife and said anode.

5. A corrosion protected knife assembly according to claim 1, said potential energy source coupled with said anode through said knife holder.

6. A corrosion protected knife assembly according to claim 1, said assembly further comprising an anvil to act against said knife blade to cut a web of material.

7. A corrosion protected knife assembly according to claim 1, said anode comprising a sacrificial anode.

8. A corrosion protected knife assembly according to claim 1, said anode comprising an impressed current anode.

* * * * *